US011375586B2

(12) United States Patent
Xiaojun et al.

(10) Patent No.: US 11,375,586 B2
(45) Date of Patent: Jun. 28, 2022

(54) ADJUSTABLE VAPORIZER THAT ACCEPTS ATOMIZERS HAVING DIFFERENT DIMENSIONS

(71) Applicant: Shenzhen Yocan Technology Co., Ltd., Guangdong (CN)

(72) Inventors: Liu Xiaojun, Guangdong (CN); Asad Awawdeh, Lodi, CA (US)

(73) Assignee: Shenzhen Yocan Technology Co., Ltd., Shenzhen (CN)

( * ) Notice: Subject to any disclaimer, the term of this patent is extended or adjusted under 35 U.S.C. 154(b) by 350 days.

(21) Appl. No.: 16/372,375

(22) Filed: Apr. 1, 2019

(65) Prior Publication Data

US 2020/0054074 A1 Feb. 20, 2020

(30) Foreign Application Priority Data

Aug. 6, 2018 (CN) ..... 201821255493.3

(51) Int. Cl.

| | |
|---|---|
| ***H05B 3/46*** | (2006.01) |
| ***A24F 9/16*** | (2006.01) |
| ***A24F 1/32*** | (2006.01) |

(52) U.S. Cl.

CPC ..... *H05B 3/46* (2013.01); *A24F 1/32* (2013.01); *A24F 9/16* (2013.01)

(58) Field of Classification Search

CPC ..... H05B 3/46; H05B 3/24; H05B 1/0227; A24F 9/16; A24F 1/32; A24F 40/10; A24F 2440/40

See application file for complete search history.

(56) References Cited

U.S. PATENT DOCUMENTS

2007/0154407 A1* 7/2007 Peters ..... A61M 11/002 424/46
2011/0253154 A1* 10/2011 Dolciato ..... A24F 13/22 131/260
2013/0255702 A1* 10/2013 Griffith, Jr. ..... A24F 40/70 131/328

FOREIGN PATENT DOCUMENTS

CN 104856236 * 8/2015

* cited by examiner

*Primary Examiner* — Timothy Kennedy
*Assistant Examiner* — Guy F Mongelli
(74) *Attorney, Agent, or Firm* — Adibi IP Group, PC; Amir V. Adibi; Andrew C. Palmer

(57) ABSTRACT

An adjustable vaporizer that receives atomizers having different dimensions is provided. In one embodiment, an adjustable vaporizer is provided that includes an adjustable aperture located at a top portion of the adjustable vaporizer that adjusts to receive atomizers having a range of diameters. The adjustable vaporizer also includes an adjustable atomizer chamber aligned with the adjustable aperture that adjusts to receive atomizers having a range of lengths.

19 Claims, 11 Drawing Sheets

ADJUSTABLE VAPORIZER THAT ACCEPTS ATOMIZERS HAVING DIFFERENT DIMENSIONS

CROSS REFERENCE TO RELATED APPLICATIONS

This application is a continuation-in-part (CIP) of a Chinese Patent Application entitled "Electronic Cigarette Capable of Being Adapted to Atomizers with Different Lengths and Diameters", having Application No. 201821255493.3, filed on Aug. 6, 2018. The entirety of the aforementioned patent document is incorporated herein by reference.

TECHNICAL FIELD

The present invention relates to vaporizers, and more specifically to adjustable vaporizers that accept atomizers having different dimensions.

BACKGROUND INFORMATION

As an alternative to cigarettes, an electronic cigarette "e-cigarette" is mainly used to simulate the feeling of smoking without affecting health. The existing electronic cigarette includes two parts, a vaporizer and an atomizer. The vaporizer includes a battery that supplies power. The atomizer includes a heating element and a liquid, which can be referred to as smoke oil. When the atomizer is installed in the vaporizer, a mechanical or pneumatic switch at one end of the vaporizer can be activated to complete an electrical circuit between the heating element and the battery. The smoke oil is atomized by the heating element and discharged from another end of the atomizer, thereby allowing a user to inhale a cloud of smoke. The smoke oil that is contained in the atomizer determines the quality and taste of the smoke.

The heating element of the atomizer is a spring-like heating wire which is formed by winding a heating wire component on a fixed carrier. When the heating wire is energized, the smoke liquid stored in the atomizer is adsorbed on the fixed carrier and atomized by the heating action of heating wire. The atomizer can be removed from the vaporizer and replaced when all the smoke oil is atomized or if the user desires to consume a different type of smoke oil.

Unfortunately, vaporizers are designed to work with atomizers having specific dimensions (e.g., fixed diameter and fixed length). Thus, for a particular vaporizer, only atomizers having dimensions compatible with that vaporizer can be used. However, consumers may desire to consume specific types of smoke oil that are only available in atomizers having different sizes. To use these atomizers it may be necessary for a consumer to purchase additional vaporizers that are compatible with the size of the atomizers. This can significantly increase costs to the consumer.

Therefore, it is desirable to have a vaporizer that can operate with atomizers having different dimensions.

SUMMARY

In various exemplary embodiments, an adjustable vaporizer is provided which can be adjusted to work with atomizers of different lengths and diameters. The adjustable vaporizer comprises an outer case composed of an outer casing and a rear cover. An atomizer is placed in an opening in the outer case that is formed by an adjustable aperture. The atomizer is held in position by rotating a turntable component on the outer case that adjusts the diameter of the aperture to exert clamping force on the atomizer. In this way the vaporizer adjusts to atomizers having different outer diameters. The adjustable vaporizer also includes components for adjusting the expansion and contraction of an atomizer chamber into which an atomizer is inserted. This allows the atomizer chamber to be adjusted to accept atomizers of different lengths. By providing adjustments for both atomizer diameter and length, the adjustable vaporizer can accept a wide range of atomizers and is therefore more flexible, convenient, and cost efficient over traditional vaporizers that accept only one size of atomizer.

In one embodiment, an adjustable vaporizer is provided that receives atomizers having a different dimensions. The adjustable vaporizer includes a case having a top portion, and an adjustable aperture located at the top portion that adjusts to receive atomizers having a range of diameters. The adjustable vaporizer also includes an adjustable atomizer chamber aligned with the adjustable aperture that adjusts to receive atomizers having a range of lengths.

In another embodiment, an adjustable vaporizer is provided that receives atomizers having a range of lengths and diameters. The adjustable vaporizer comprises means for adjusting a diameter of an adjustable aperture to receive atomizers having different diameters. The adjustable vaporizer also comprises means for adjusting a depth of an atomizer chamber that is aligned with the adjustable aperture to receive atomizer having different lengths.

In another embodiment, a method is provided for operating an adjustable vaporizer that receives atomizers having a range of lengths and diameters. The method comprises adjusting a depth of an atomizer chamber to receive atomizers having different lengths, and adjusting a diameter of an adjustable aperture to receive atomizers having different diameters.

The foregoing is a summary and thus contains, by necessity, simplifications, generalizations and omissions of detail; consequently it is appreciated that the summary is illustrative only. Still other methods, and structures and details are set forth in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

In various exemplary embodiments, an adjustable vaporizer that accepts atomizers having different dimensions is disclosed. Reference will now be made in detail to some embodiments of the adjustable vaporizer, examples of which are illustrated in the accompanying drawings.

Figure 1:
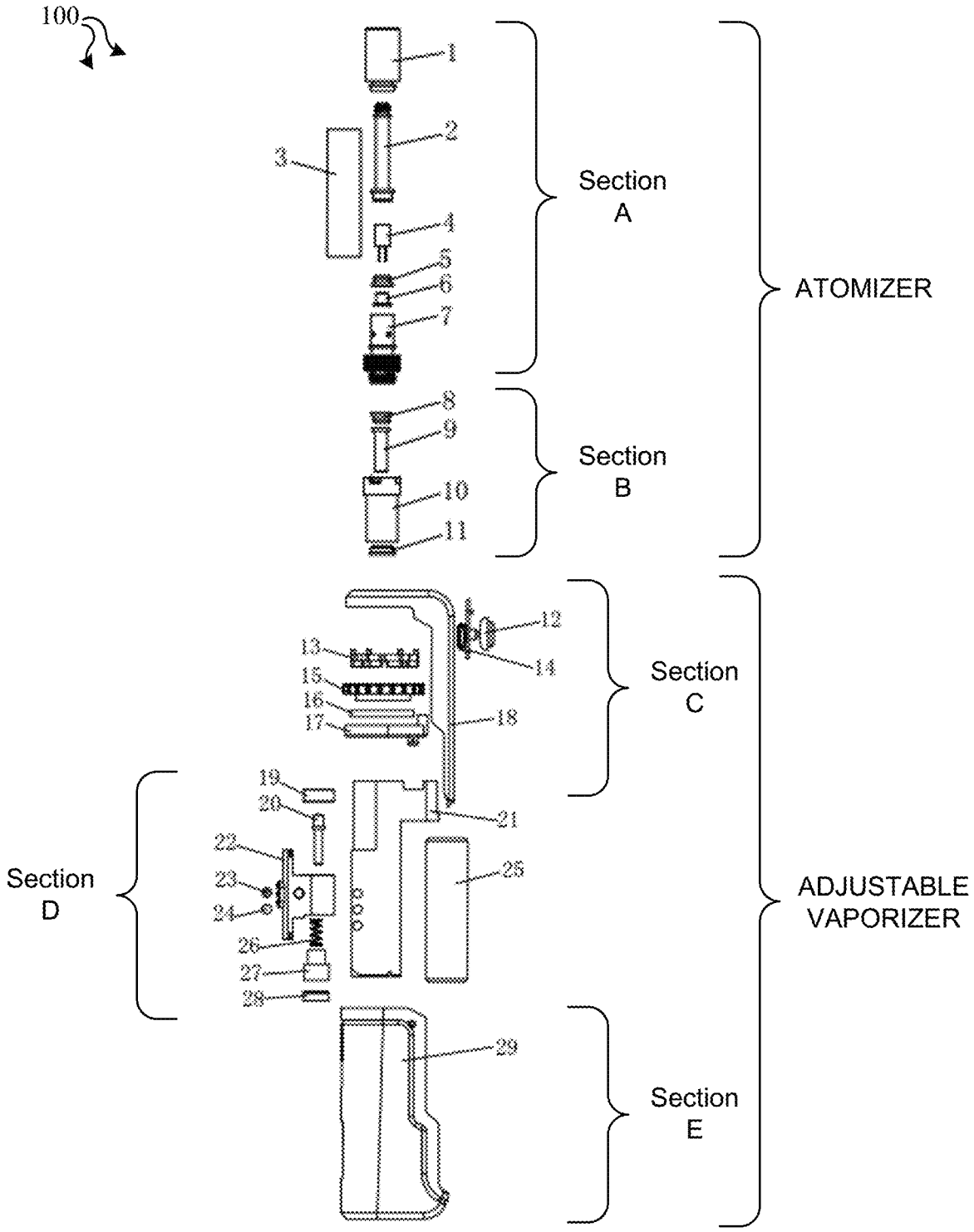
FIG. 1 shows an exploded view of an atomizer and an exemplary embodiment of an adjustable vaporizer.

FIG. 1 shows an exploded view of an atomizer and an exemplary embodiment of an adjustable vaporizer. As illustrated in FIG. 1, the exploded view comprises components 1-29. The components 1-29 are grouped into sections A-E. For example, section A includes components 1-7, section B included components 8-11, section C includes components 12-18, section D includes components 19-28, and section E includes component 29. In an exemplary embodiment, the atomizer comprises the components in sections A-B and the adjustable vaporizer comprises the components in sections C-E. More detailed descriptions of the components included in each section are provided below.

Figure 2:
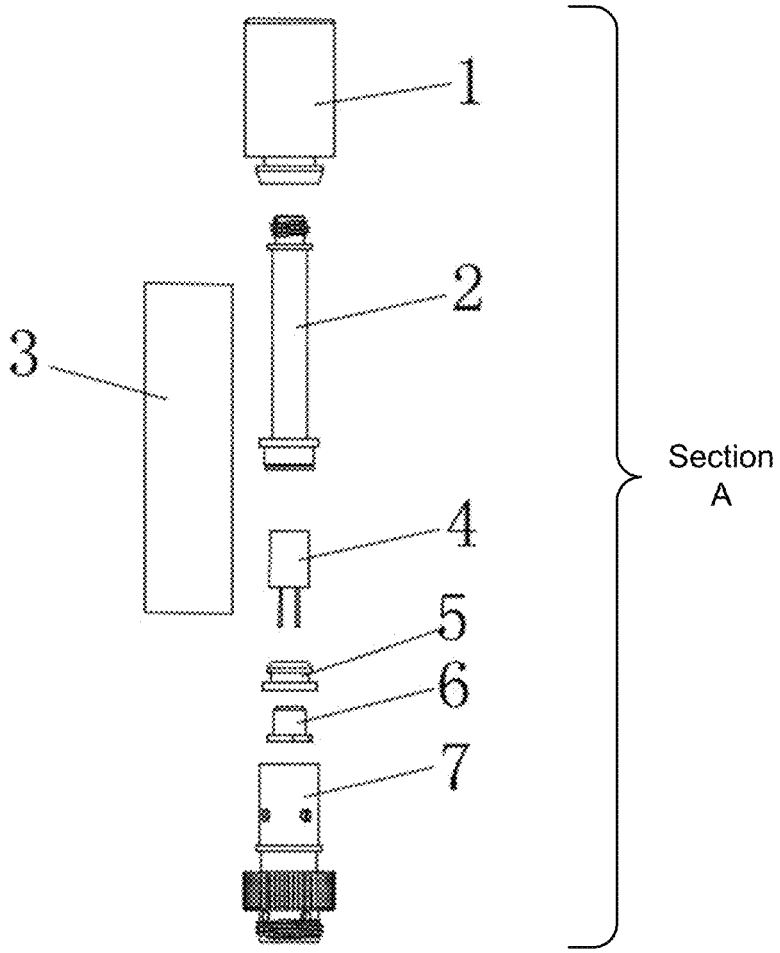
FIG. 2 shows a detailed exemplary embodiment of components included in section A of the exploded view shown in FIG. 1.

FIG. 2 shows a detailed exemplary embodiment of components included in section A of the atomizer shown in FIG. 1. As illustrated in FIG. 2, section A includes components 1-7. For example, the components of section A include mouthpiece 1, atomizer connector 2 having a through-hole, glass sleeve 3, ceramic heating element 4, atomizer rubber doughnut 5, hollow electrode 6, and inner atomizer electrode holder 7.

The lower portion of the atomizer mouthpiece 1 is provided with a cone boss, and the cone boss is provided with a through-hole. The inside of the through-hole is provided with an internal thread and the atomizer connector 2 is connected to the mouthpiece 1 through the internal thread.

The lower end of the atomizer mouthpiece 1 is screwed to the atomizer connector 2, and the glass sleeve 3 is jacketed on the atomizer connector 2. The upper end of the glass sleeve 3 is placed on the lower end side edge of the atomizer mouthpiece 1 to cover the cone boss of the lower end of the atomizer mouthpiece 1. The lower end of the atomizer connector 2 wraps the upper end of the atomizer electrode holder 7.

The ceramic heating element 4 is placed at the step of an upper portion of the inner atomizer electrode holder 7. The hollow electrode 6 and the atomizer rubber donut 5 are sequentially placed in a lower portion of the inner atomizer electrode holder 7. The hollow electrode 6 is inserted into the through-hole of the atomizer rubber donut 5. The ceramic heating element 4 is wound with heating wire. The lower cylinder outer wall of the atomizer electrode holder 7 is provided with multiple holes for smoke extraction.

Figure 3:
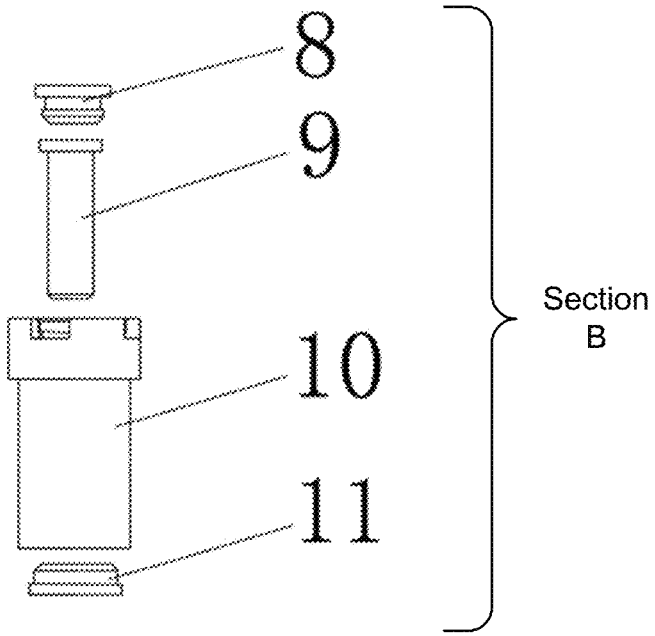
FIG. 3 shows a detailed exemplary embodiment of components included in section B of the of the exploded view shown in FIG. 1.

FIG. 3 shows a detailed exemplary embodiment of components included in section B of the atomizer shown in FIG. 1. As illustrated in FIG. 3, section B includes components 8-11. For example, the components of section B include a first adapter rubber doughnut 8, adapter electrode 9, adapter electrode holder 10, and second adapter rubber doughnut 11. The components of sections A-B fit together to complete the atomizer assembly.

Figure 4:
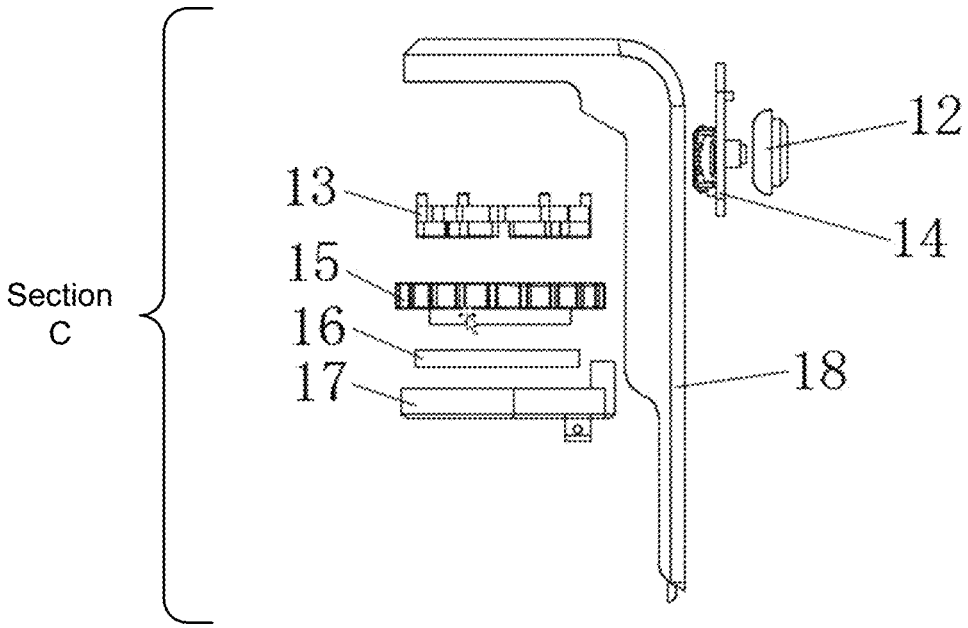
FIG. 4 shows a detailed exemplary embodiment of components included in section C of the of the exploded view shown in FIG. 1.

FIG. 4 shows a detailed exemplary embodiment of components included in section C of the adjustable vaporizer shown in FIG. 1. The components of section C can be referred to as turntable components that control an adjustable aperture of the adjustable vaporizer to allow the adjustable vaporizer to accept atomizers having different diameters.

As illustrated in FIG. 4, section C includes components 12-18. For example, the components of section C include work switch 12, multiple diameter plates 13, printed circuit board (PCB) 14, turntable 15, turntable silicone 16, lower cover 17, and rear cover 18. A more detailed description of the components in section C is provided below.

Figure 5:
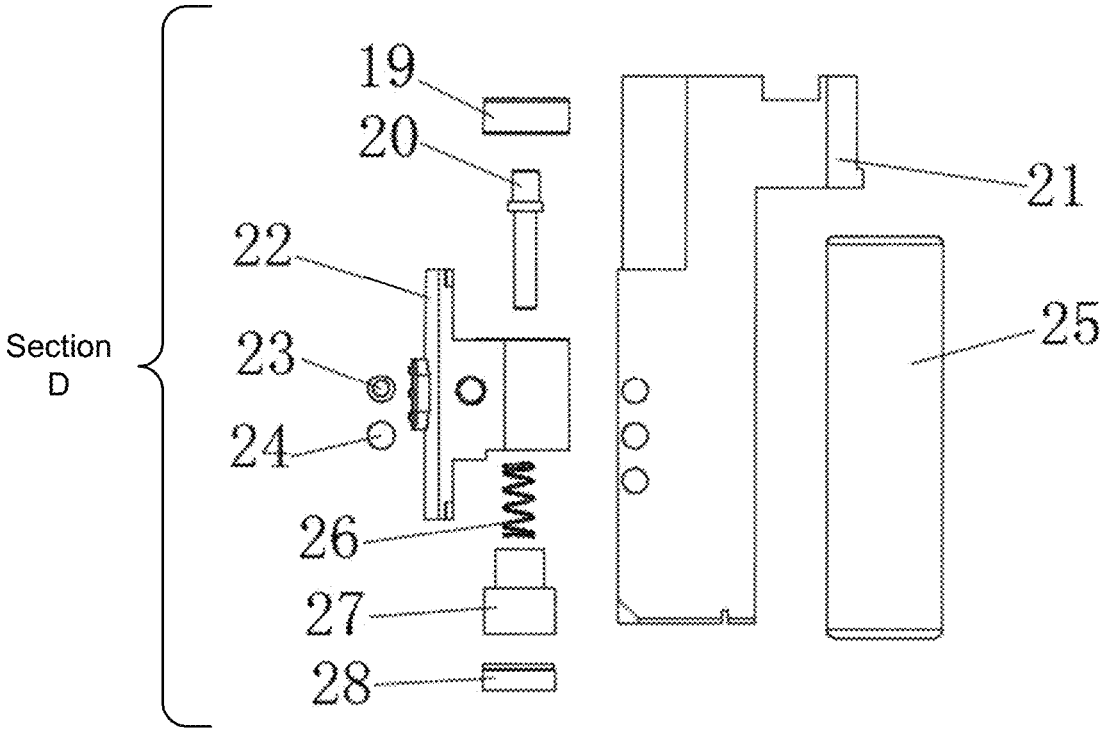
FIG. 5 shows a detailed exemplary embodiment of components included in section D of the of the exploded view shown in FIG. 1.

FIG. 5 shows a detailed exemplary embodiment of components included in section D of the adjustable vaporizer shown in FIG. 1. The components of section D can be referred to as button components that control the depth of an atomizer chamber of the adjustable vaporizer to allow the adjustable vaporizer to accept atomizers having different lengths.

As illustrated in FIG. 5, section D includes components 19-28. For example, the components of section D include work magnet 19, base electrode 20, bracket 21, button adapter base 22, spring 23, bead 24, battery 25, adapter base spring 26, first adapter base insulating doughnut 27, and second adapter base insulating doughnut 28. A more detailed description of the components in section D is provided below.

Figure 6:
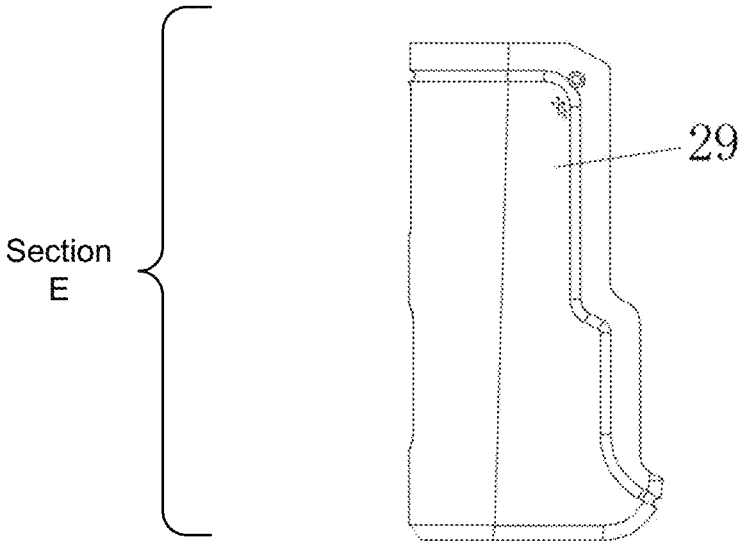
FIG. 6 shows an exemplary embodiment of an outer case component included in section E of the of the exploded view shown in FIG. 1.

FIG. 6 shows a detailed exemplary embodiment of the component included in section E of the adjustable vaporizer shown in FIG. 1. The component in section E comprises an outer case 29 of the adjustable vaporizer shown in FIG. 1. The outer casing 29 is provided with a battery receiving cavity, which is a vertical cavity that holds the battery 25 shown in section D.

Figure 7:
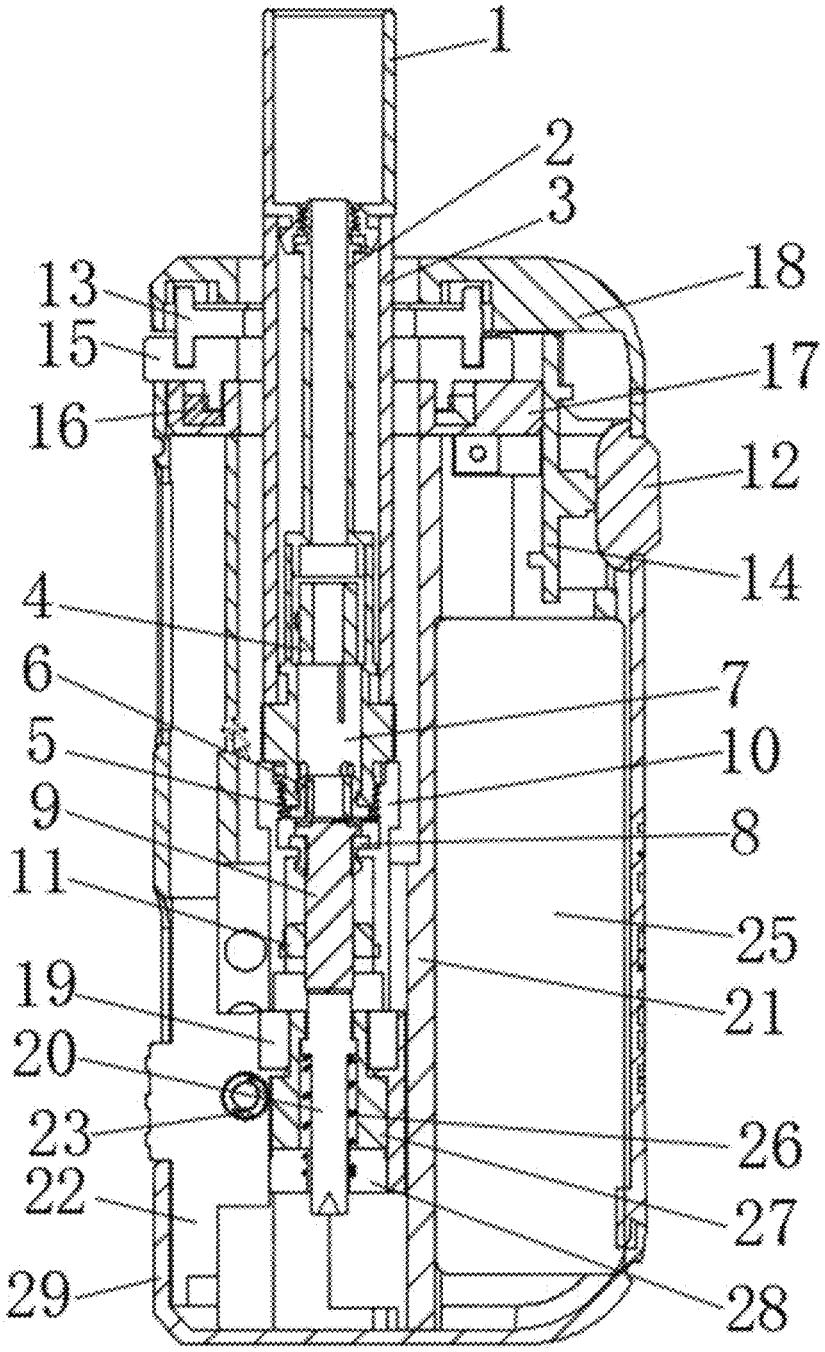
FIG. 7 shows an exemplary embodiment of the assembled components of the atomizer and adjustable vaporizer shown in FIG. 1.

FIG. 7 shows an exemplary embodiment of a cross-sectional view of the assembled components of the atomizer and adjustable vaporizer shown in FIG. 1. The cross-sectional view shown in FIG. 7 illustrates how all the components of sections A-E fit together.

As illustrated in FIG. 7, the turntable 15 operates to adjust the adjustable aperture to allow the adjustable vaporizer to accept atomizers having different diameters. Also shown in FIG. 7, the button adapter base 22 operates to adjust the atomizer chamber depth to allow the adjustable vaporizer to accept atomizers having different lengths.

Figure 8:
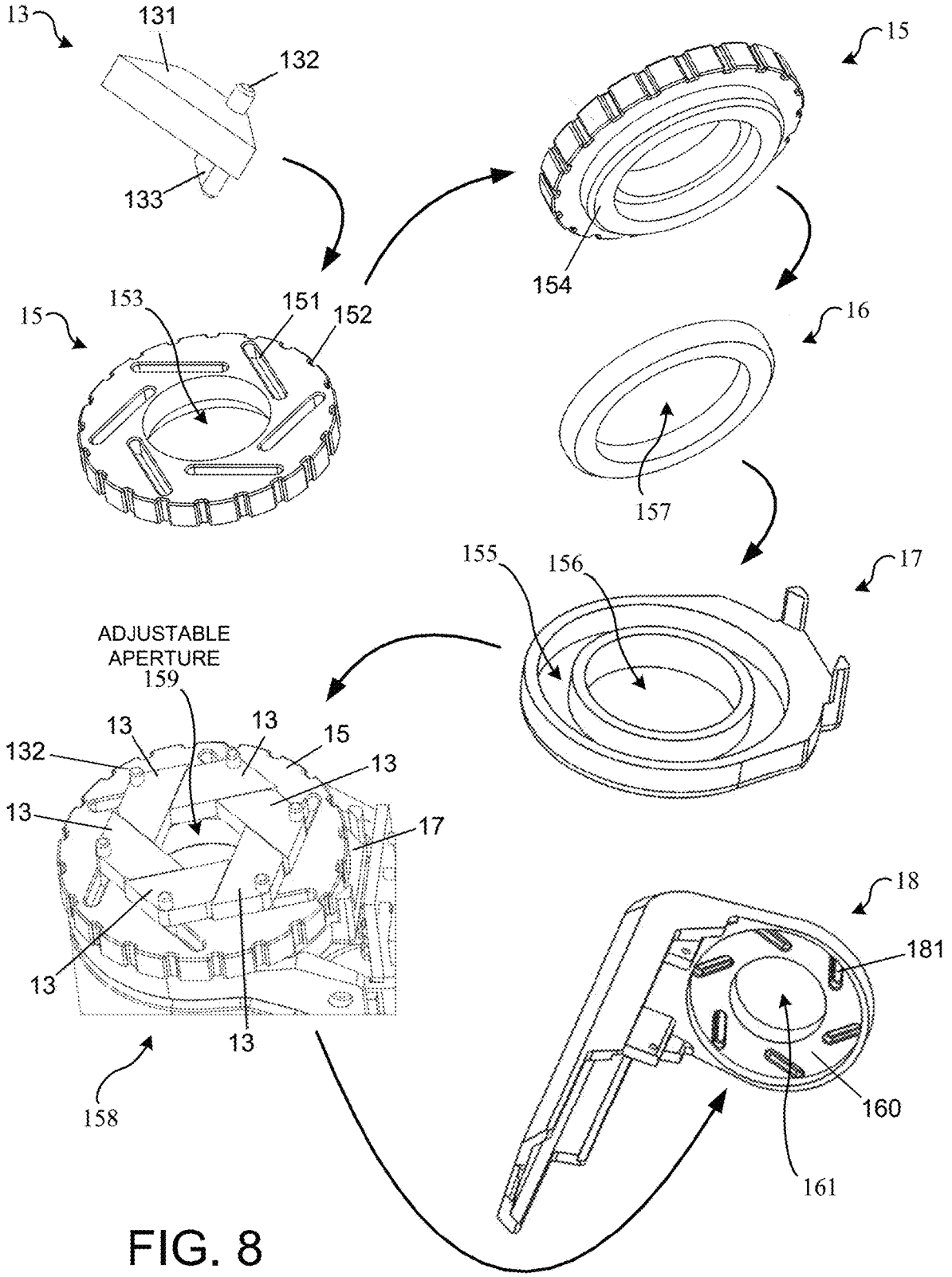
FIG. 8 shows perspective views of exemplary embodiments of turntable components included in section C.

FIG. 8 shows perspective views of exemplary embodiments of the components 13, 15, 16, 17, 18 and of section C. As illustrated in FIG. 8, the components 13, 15, 16, 17, 18 fit together to provide an adjustable aperture for the adjustable vaporizer shown in FIG. 1.

As illustrated in FIG. 8, a diameter plate 13 is shown. In an exemplary embodiment, the adjustable vaporizer utilizes six diameter plates to provide an adjustable aperture. The diameter plate 13 includes a trapezoidal body 131 having a round convex pillar (or pin) 132 on the right side of a top surface. The trapezoidal body 131 includes a slanting plate 133 on the right side of a lower surface. The slanting plate 133 aligns with the angle of the right edge of the trapezoidal body 131.

Also illustrated in FIG. 8 is the turntable 15 that includes a textured edge surface 152. For example, in this embodiment, the textured edge surface includes grooves 152 that provide friction to allow the turntable to be manual rotated by the fingers of a user without slipping. The turntable 15 also includes an opening 153 that will allow an atomizer to pass through. The top surface of the turntable 15 includes multiple round chutes 151 that are shaped to accept the slanting plate 133 of diameter plates 13. Thus, in this embodiment, six diameter plates 13 can be mounted or installed into six round chutes 151 of the turntable 15.

A bottom view of the turntable 15 illustrates a convex circular feature 154 that provides a bottom surface on which the turntable slides when rotated. The bottom circular feature 154 of the turntable 15 mates with the turntable silicone 16 (having opening 157) and together these components are inserted into an annular groove 155 of the lower cover 17. The lower cover 17 is located on the upper portion of the outer casing 29, and the outer ring of the turntable 15 is exposed at a joint between the outer casing 29 and the rear cover 18. The lower cover 17 also includes an opening 156. When assembled, the turntable opening 153, the turntable silicone opening 157, and the lower cover opening 156 all align to allow an atomizer to pass through.

The perspective view 158 illustrates the assembly of diameter plates 13, turntable 15, turntable silicone 16, and lower cover 17. As can be seen in the view 158, six plates 13 combine to form an adjustable aperture 159. For example, a middle portion of each diameter plate 13 forms a jaw for holding an atomizer in position. Rotating the turntable 15 can enlarge or reduce the aperture 159 formed by the six jaws of the diameter plates.

A bottom perspective view of the rear cover 18 is shown. A top portion of the rear cover 18 is provided with a round cover 160 having a through-hole or opening 161. The round cover 160 includes second round chutes 181 arranged on a bottom surface inside the round cover 160. The second round chutes 181 are located on the bottom surface of the round cover 160 to correspond with the first round chutes 151. The assembly shown in view 158 mounts to the rear cover 18 so that the round pillars or pins 132 of the diameter plates 13 are inserted within the second round chutes 181. Thus, the pins 132 are restricted to move within the second round chutes 181 and the slanting plate 133 are restricted to move within the first round chutes 151. When the turntable 15 is manually rotated, the restrictions on the slanting plates 133 and the pins 132 cause the diameter plates 13 to move such that the adjustable aperture 159 increases or decreases in size. For example, rotating the turntable 15 drives the diameter plates 13 to move along the first round chutes 151 and the second round chutes 181 so that the gap of the middle part of each of the diameter plates is enlarged or reduced after being moved to form the adjustable aperture 159.

Figure 9:
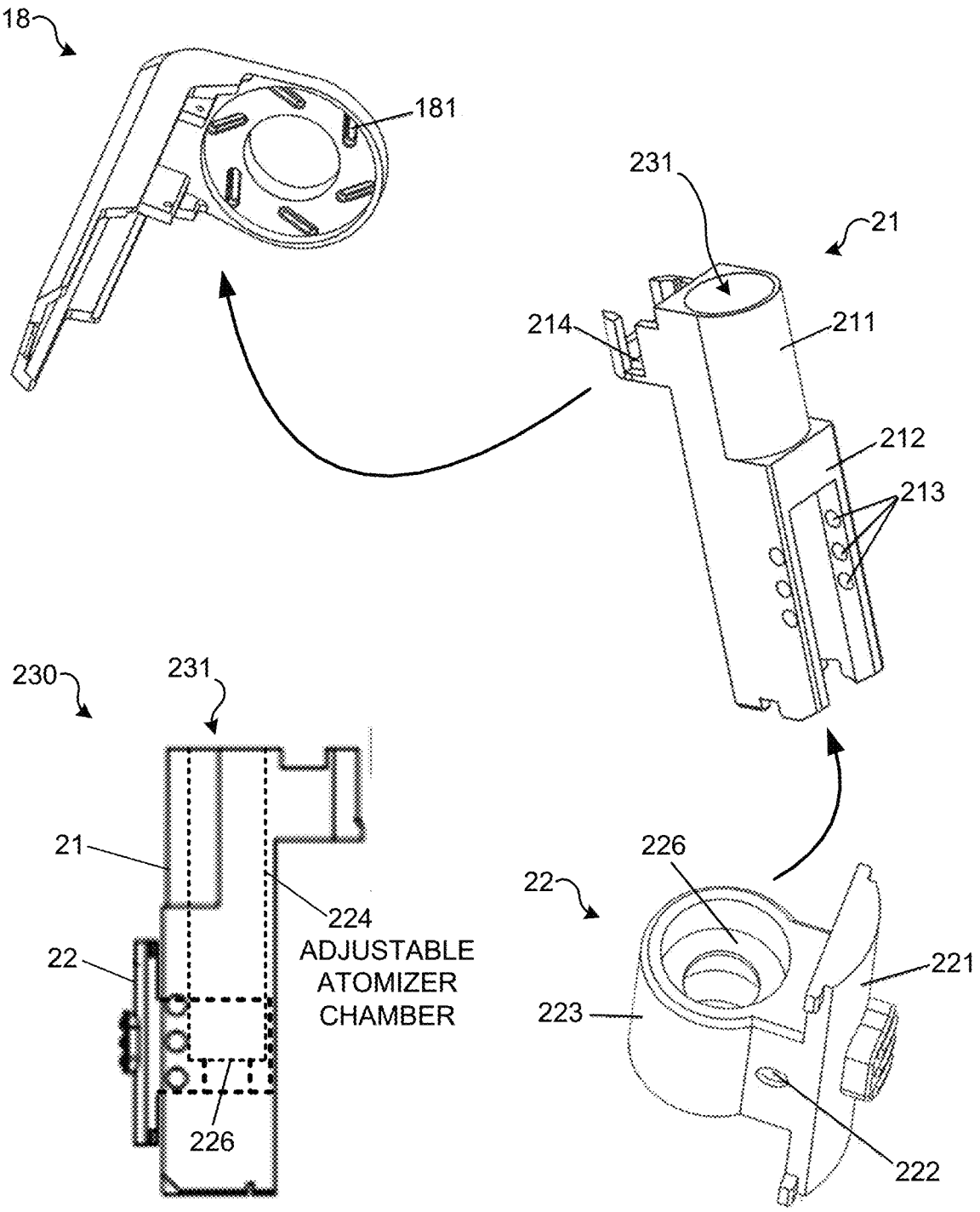
FIG. 9 shows perspective views of exemplary embodiments of button components included in section D.

FIG. 9 shows perspective views of exemplary embodiments of the component 18 of section C and components 21 and 22 of section D. As illustrated in FIG. 9, the components 18, 21, and 22 fit together to provide an adjustable depth atomizer chamber for the adjustable vaporizer shown in FIG. 1.

The bracket 21 is located in the outer casing 29, and a cylinder 211 is cut out on an upper side of the bracket 21. An opening for an atomizer chamber 231 is formed within the cylinder 211. The cylinder 211 is provided with adapter parts therein, and one side of the cylinder is provided with a sliding block that includes a mounting slot 214 that slides in the inner side sliding groove of the front cover 18. The lower part of the bracket 21 forms a square body 212 that includes a square notch that is opened on one side of the square body. Multiple rows of coaxial holes 213 are located on both side boards of the square notch.

The button adapter base 22 is provided with a side plate 221 that is capable of sliding within the square notch of the bracket 21 and along the multiple of coaxial holes 213. A bearing cylinder 223 is located on an inner side of the side plate 221. Within the bearing cylinder 223 is a chamber base surface 226 that forms an adjustable atomizer chamber base when the button 22 is assembled with the bracket 21.

A circular hole 222 is provided at a side of the joint between the side plate 221 and the bearing cylinder 223. A second circular hole on the backside of the button 22 is unseen in this view but is located in a similar position on the button 22 as the circular hole 222.

The spring 23 and two beads 24 (not shown) are combined so that the two beads 24 are placed at both ends of the spring 23. The spring 23 and beads 24 are captured with the two circular holes 222 so that a portion of each bead protrudes through each circular hole 222. When the bearing cylinder 223 is inserted into the bracket 21, the portion of the beads 24 protruding through the circular holes 222 can embed in corresponding coaxial holes 213. Thus, when the bearing cylinder 223 of the button adapter base 22 is placed in the gap of the square 212, the beads vertically slide and lock into selected coaxial holes 213, which allows adapter base 22 to move up and down by the bearing cylinder 223, thereby controlling the expansion and contraction of the atomizer chamber as the chamber base surface 226 moves with the position of the button 22.

In an exemplary embodiment, the bearing cylinder 223 is provided with a donut plate in the through-hole, and the lower side cavity of the donut plate is provided with first adapter base insulating donut 27. The first adapter base insulating donut 27 is provided with the adapter base electrode 2 in the through-hole. The upper side edge of the adapter base electrode 20 provided with a convex ring, the top of it sits against the upper through-hole step of the first adapter base insulating donut 27, and below is provided with an adapter base spring 26. The outer side of the upper cylinder of the first adapter base insulation donut 27 is arranged at the lower annular surface of the donut plate bearing the cylinder 223 and is provided with a magnet 19 on the outer wall of the upper first adapter base insulating donut 27. The magnet 19 is placed on the upper of the donut plate, the lower end face of the first adapter base insulation donut 27 is provided with a second adapter base insulation donut 28.

The upper of adapter base electrode 20 contacts the adapter electrode 9, and the adapter electrode 9 is sleeved with a second adapter rubber donut 11, which is located in the through-hole of the adapter electrode holder 10, and is provided with a first adapter rubber donut 8 between the through-hole and the inner donut of the adapter electrode holder 10. The top of adapter electrode 9 is in contact with the lower of the hollow electrode 6, and the top of the adapter electrode holder 10 is threaded to connect the lower end of the atomizer electrode holder 7.

An assembly view 230 shows the assembly of the button adapter base 22 with the bracket 21. When these components are assembled, an adjustable atomizer chamber 224 is formed. The adjustable atomizer chamber 224 can receive atomizers of varying lengths. A chamber base surface 226 moves up and down with the movement of the button 22 so that the atomizer chamber provides an adjustable depth. For example, pushing up the button adapter base 22 causes the chamber base surface 226 to rise, thereby raising the position of the atomizer and exposing the atomizer to a greater extent outside the casing. Pushing the button adapter base 22 down causes the chamber base surface 226 to lower, thereby lowering the position of the atomizer so that a portion of the nozzle of the atomizer is received within the vaporizer housing.

Figure 10:
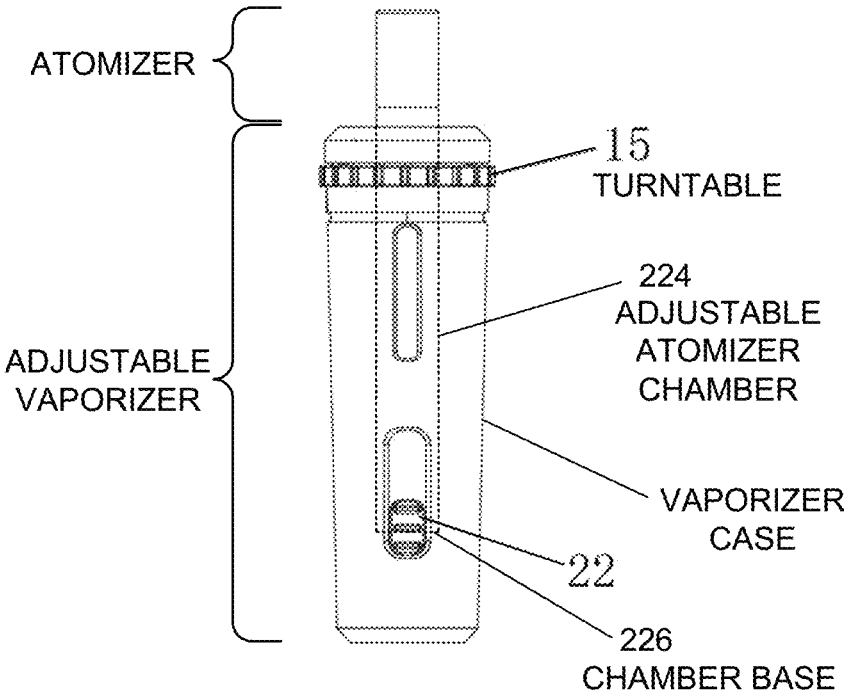
FIG. 10 shows an exemplary embodiment of a side view of the assembled adjustable vaporizer with an installed atomizer.

FIG. 10 shows an exemplary embodiment of a side view of the assembled adjustable vaporizer with an installed atomizer. As illustrated in FIG. 10, the turntable 15 is used to adjust the diameter of an opening (or aperture) into which the atomizer is inserted into the adjustable vaporizer. The button adapter base 22 is used to adjust the chamber base 226 to adjust the depth of the atomizer chamber 224. By adjusting the depth of the atomizer chamber 224, atomizers of different lengths can be received by the adjustable vaporizer.

Figure 11:
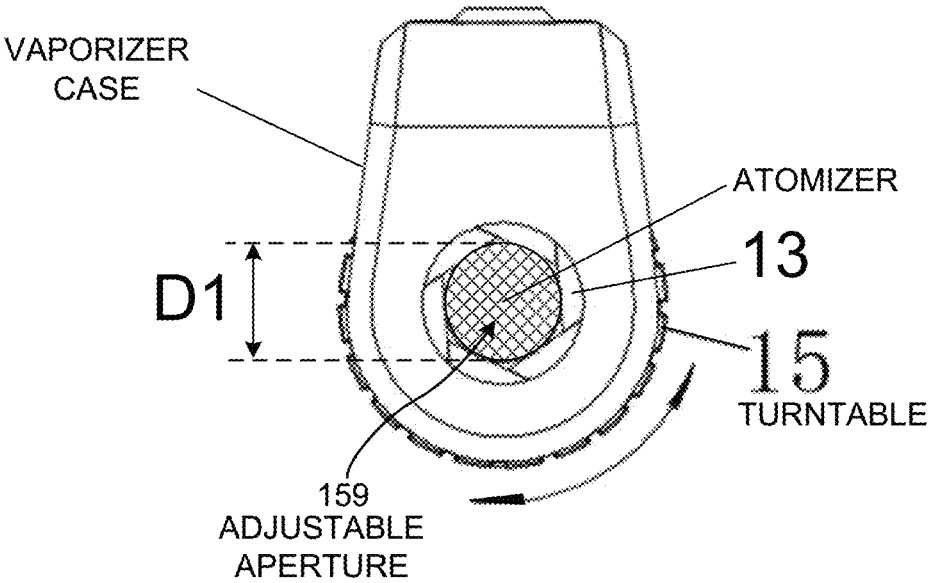
FIG. 11 shows an exemplary embodiment of a top view of the assembled adjustable vaporizer with an installed atomizer.

FIG. 11 shows an exemplary embodiment of a top view of the adjustable vaporizer with an installed atomizer. This top view illustrates how rotating the turntable 15 causes the diameter plates 13 to adjust the size of the adjustable aperture to receive atomizers of different diameters. For example, as shown in FIG. 11, the vaporizer is set to accept an atomizer having a diameter Dl. Rotating the turntable 15 will allow the vaporizer to accept atomizers having diameters larger or smaller than Dl.

Figure 12:
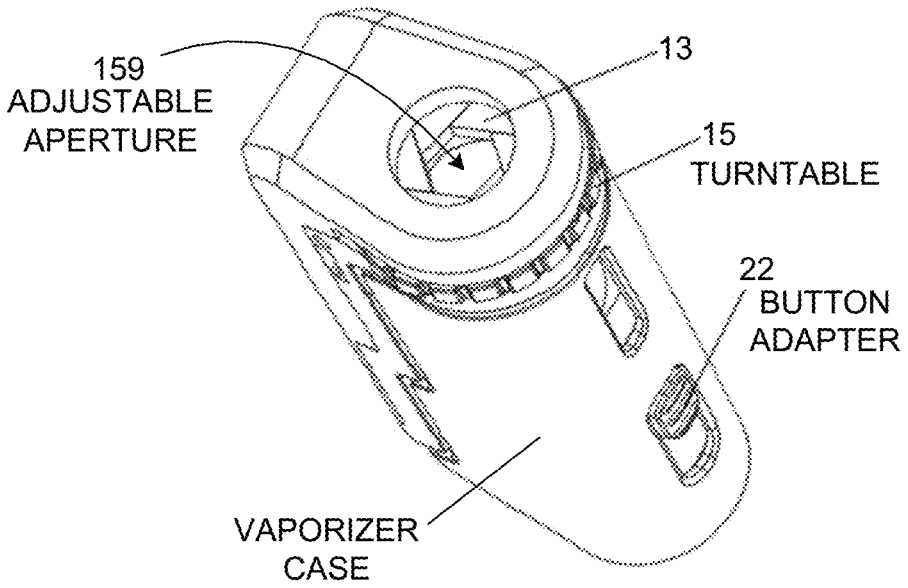
FIG. 12 shows an exemplary embodiment of a perspective view of the assembled adjustable vaporizer shown in FIG. 7.

FIG. 12 shows an exemplary embodiment of a perspective view of the assembled adjustable vaporizer shown in FIG. 7. As illustrated in FIG. 12, rotating the turntable 15 moves the diameter plates 13 causing the size of the adjustable aperture 159 to increase or decrease. Sliding the button adapter base 22 causes the chamber base 226 to adjust the depth of the atomizer chamber 224. By adjusting the depth of the atomizer chamber 224, atomizers of different lengths can be received by the adjustable vaporizer.

Figure 13:
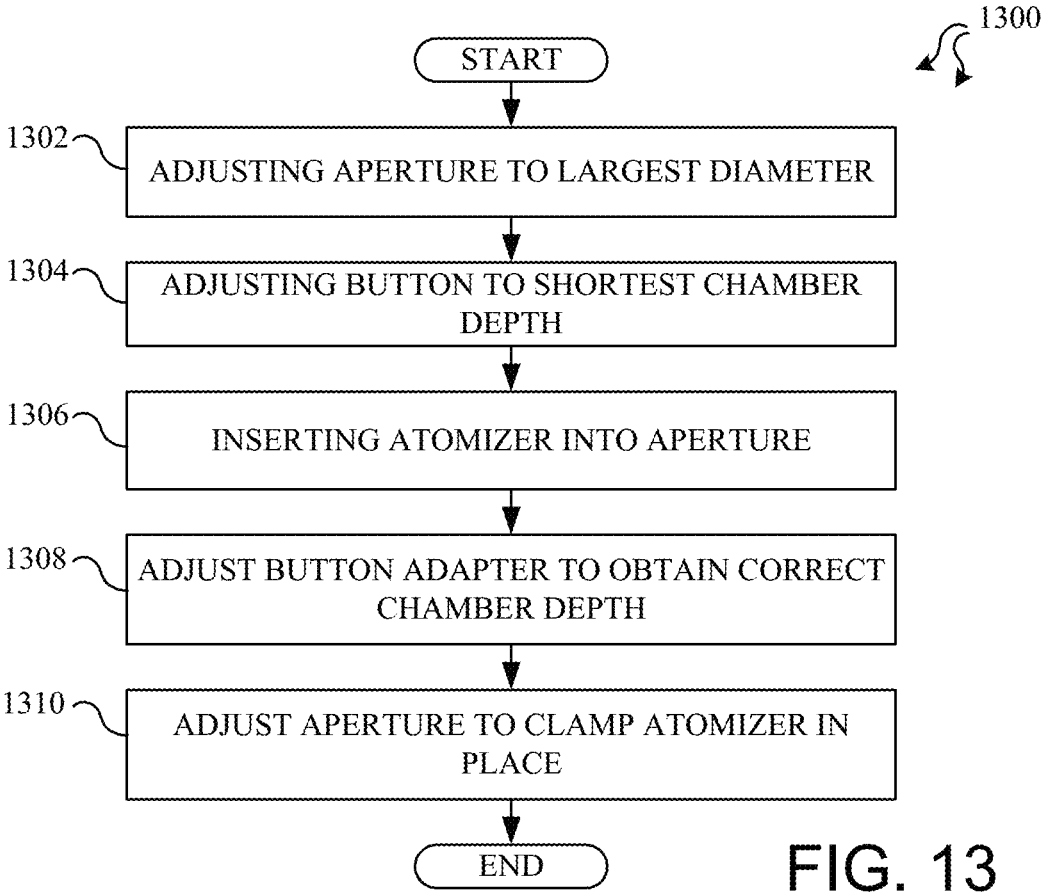
FIG. 13 shows an exemplary embodiment of a method for operating an adjustable vaporizer to utilize atomizers having different dimensions.

FIG. 13 shows an exemplary embodiment of a method 1300 for operating an adjustable vaporizer to utilize atomizers having different dimensions. For example, the method 1300 is suitable for use with the adjustable vaporizer shown in FIG. 1, FIG. 7, and various other figures described herein.

At block 1302, an adjustable aperture of the adjustable vaporizer is adjusted to its largest diameter. For example, the turntable 15 is rotated to move the diameter plates 13 to increase the size of the adjustable aperture to its largest size.

At block 1304, an atomizer chamber is adjusted to its shortest length. For example, the button adapter base 22 is raised to its highest position to raise the chamber base 226 to adjust the depth of the atomizer chamber 224 to its shortest depth.

At block 1306, an atomizer is inserted into the aperture. For example, an atomizer having a diameter within a selected diameter range and a length within a selected length range is inserted into the adjustable aperture 159 of the adjustable aperture until it contacts the chamber base 226.

At block 1308, the atomizer chamber is adjusted to obtain a desired chamber depth. For example, the button adapter base 22 is moved to a position that adjusts the chamber base 226 to adjust the depth of the atomizer chamber 224 to accommodate the length of the inserted atomizer. For example, the atomizer chamber is adjusted so that the inserted atomizer extends a desired distance above the top of the adjustable vaporizer.

At block 1310, the adjustable aperture is adjusted to clamp the atomizer in place. For example, the turntable 15 is rotated to move the diameter plates 13 to contact the sides of the inserted atomizer thus clamping or securing the atomizer in the adjustable vaporizer.

It should be noted that the method 1300 is exemplary and that changes, modifications, deletions, or additions to the method operations are within the scope of the exemplary embodiments.

Figure 14:
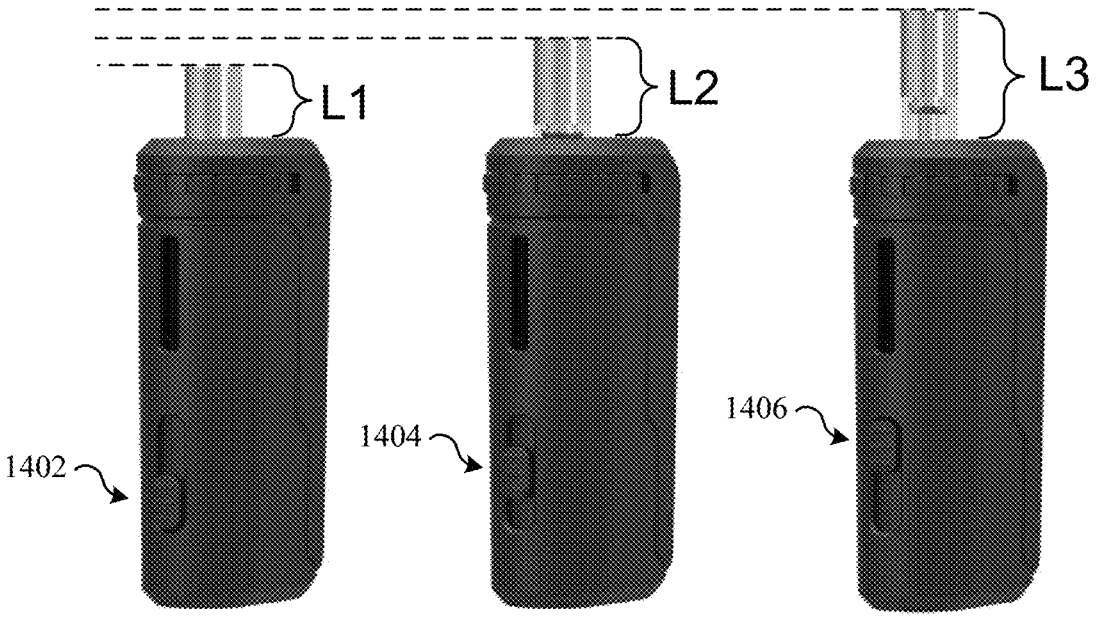
FIG. 14 shows a diagram that illustrates how the button components adjust for atomizers of different lengths.

FIG. 14 shows a diagram that illustrates how operating the button components adjusts the adjustable vaporizer for atomizers having different lengths. For example, with the button adapter base is set at a first position 1402, the atomizer chamber is set to its largest depth, which results in the exposure of the atomizer above the vaporizer to be set to the length L1. When the button adapter base is set at a second position 1404, the atomizer chamber is set to its mid-range depth, which results in the exposure of the atomizer above the vaporizer to be set to the length L2. When the button adapter base is set at a third position 1406, the atomizer chamber is set to its shortest depth, which results in the exposure of the atomizer above the vaporizer to be set to the length L3. In an exemplary embodiment, the first, second, and third positions correspond to the lock-in of the spring 23 and two beads 24 into each of the three coaxial holes 213. In an exemplary embodiment, the atomizer chamber depth can be adjusted up to 10 millimeters from the first position 1402 to the third position 1406. In other embodiments, the atomizer chamber depth can be adjusted over a much larger distance that is greater than 10 millimeters.

Figure 15:
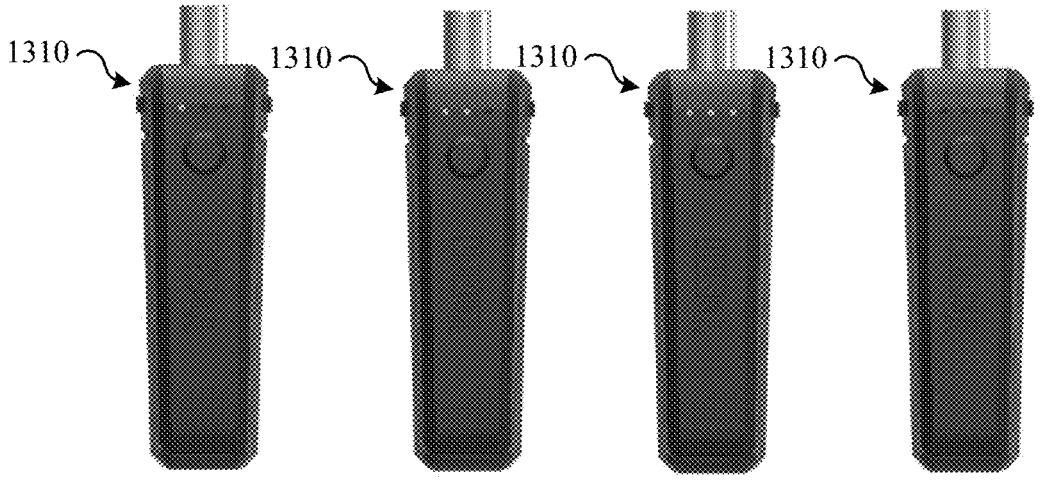
FIG. 15 shows a diagram that illustrates various LED configurations of the adjustable vaporizer.

FIG. 15 shows a diagram that illustrates various LED configurations of the adjustable vaporizer. In an exemplary embodiment, the LEDs indicate status conditions of the adjustable vaporizer.

Figure 16:
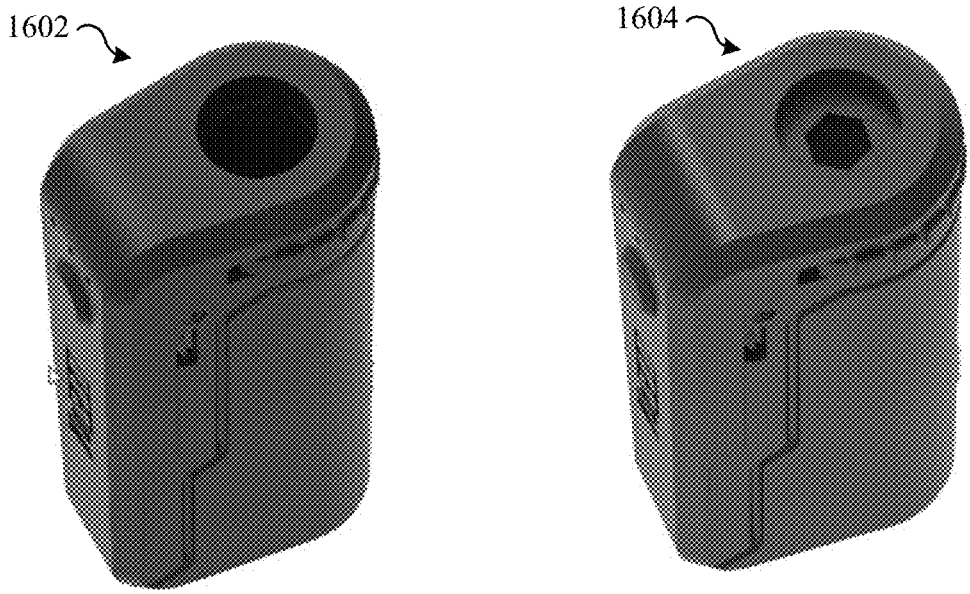
FIG. 16 shows a diagram that illustrates the adjustment of the aperture from a largest to a smallest diameter.

FIG. 16 shows a diagram that illustrates the adjustment of the adjustable aperture from a fully open position 1602 (largest diameter) to a most closed position 1604 (smallest diameter). This illustrates the range of atomizer diameters that can be utilized with the adjustable vaporizer. In an exemplary embodiment, the diameter of the adjustable aperture can adjust from 6-12 millimeters. In another exemplary embodiment, the diameter of the adjustable aperture can adjust over a much greater range.

Figure 17:
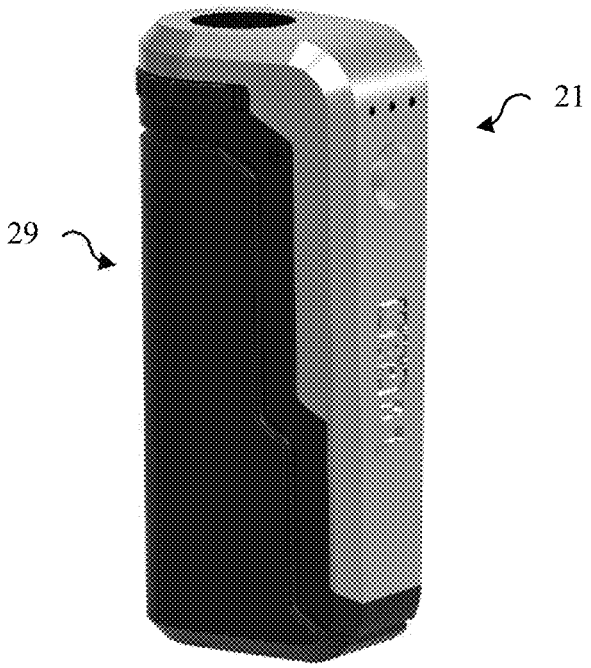
FIG. 17 shows a diagram of an adjustable vaporizer.

FIG. 17 shows an exemplary embodiment of an adjustable vaporizer. This embodiment illustrates the adjustable vaporizer with an outer case component 29 that is made of plastic and a bracket 21 that is made of metal.

In various exemplary embodiments, an adjustable vaporizer is provided that adjusts the size of an aperture by the rotating turntable to accept atomizers of different diameters. The adjustable vaporizer also includes a push-pull button that adjusts the expansion and contraction of an atomizer chamber to accept atomizers of different length. Thus, the adjustable vaporizer can be adjusted to accept atomizers having different lengths and diameters.

Although certain specific exemplary embodiments are described above in order to illustrate the invention, the invention is not limited to the specific embodiments. Accordingly, various modifications, adaptations, and combinations of various features of the described embodiments can be practiced without departing from the scope of the invention as set forth in the claims.

What is claimed is:

1. An adjustable vaporizer that receives atomizers having a range of lengths and diameters, the adjustable vaporizer comprising:

a case;

an adjustable aperture located on the case that adjusts to receive atomizers having a range of diameters;

an adjustable atomizer chamber aligned with the adjustable aperture that adjusts to receive atomizers having a range of lengths; and turntable components that adjust the adjustable aperture, wherein the turntable components include a turntable that is rotated in a first direction to increase a size of the adjustable aperture and rotated in a second direction to decrease the size of the adjustable aperture, wherein the turntable components include a plurality of diameter plates that have slating plates that are inserted into corresponding chutes in the turntable, wherein each diameter plate has a pin on a top surface, and wherein the plurality of diameter plates each have a surface that forms a part of the adjustable aperture.

2. The adjustable vaporizer of claim 1, wherein a side wall of the turntable includes grooves for increasing friction.

3. The adjustable vaporizer of claim 2, wherein the side wall of the turntable extends outside the case.

4. The adjustable vaporizer of claim 1, further comprising:

a silicone component; and a lower cover having an annular groove, wherein the silicone component is inserted in the annular groove to form a reduced friction surface, and wherein the turntable is inserted into the annular groove onto the reduced friction surface to form a turntable assembly.

5. The adjustable vaporizer of claim 4, further comprising a rear cover that includes a round cover, wherein the round cover includes a plurality of second round chutes, wherein the turntable assembly mounts to the rear cover so that the pins on the diameters plates are inserted into the second round chutes, and wherein the first and second chutes restrict the slanting plates and the pins, respectively, so that rotating the turntable causes the adjustable aperture to increase or decrease in size.

6. The adjustable vaporizer of claim 1, wherein the adjustable aperture is located on a top portion of the case.

7. The adjustable vaporizer of claim 1, further comprising one or more indicators that indicate a status of the adjustable vaporizer.

8. An adjustable vaporizer that receives atomizers having a range of lengths and diameters, the adjustable vaporizer comprising:

a case;

an adjustable aperture located on the case that adjusts to receive atomizers having a range of diameters;

an adjustable atomizer chamber aligned with the adjustable aperture that adjusts to receive atomizers having a range of lengths; and button components that adjust a depth of the adjustable atomizer chamber.

9. The vaporizer of claim 8, wherein the button components comprise:

a bracket; and a button adapter base having a cylinder that fits into the bracket so that the bracket and the button adapter base form the adjustable atomizer chamber.

10. The adjustable vaporizer of claim 9, wherein the button adapter base includes a chamber base surface that forms a bottom of the adjustable atomizer chamber.

11. The adjustable vaporizer of claim 10, wherein the button adapter slides within the front cover to adjust a depth of the adjustable atomizer chamber.

12. The adjustable vaporizer of claim 11, wherein the button adapter slides between one of three locking positions.

13. The adjustable vaporizer of claim 12, wherein the button adapter is located on a side surface of the adjustable vaporizer.

14. An adjustable vaporizer that adjusts to receive atomizers having a range of lengths and a range of diameters, the adjustable vaporizer comprising:

a turntable that adjusts a diameter of an adjustable aperture to receive a selected atomizer having a selected diameter within the range of diameters, wherein the turntable is rotated in a first direction to increase a size of the adjustable aperture and rotated in a second direction to decrease the size of the adjustable aperture; and means for adjusting a depth of an atomizer chamber that is aligned with the adjustable aperture to receive the selected atomizer having a selected length within the range of lengths.

15. The adjustable vaporizer of claim 14, wherein the means for adjusting the depth of the atomizer chamber comprises a button adapter that slides along a side surface of the vaporizer to adjust the depth of the atomizer chamber.

16. The adjustable vaporizer of claim 8, wherein the adjustable aperture is located on a top portion of the case.

17. The adjustable vaporizer of claim 8, further comprising one or more indicators that indicate a status of the adjustable vaporizer.

18. The adjustable vaporizer of claim 14, wherein the adjustable aperture is located on a top portion of the case.

19. The adjustable vaporizer of claim 14, further comprising one or more indicators that indicate a status of the adjustable vaporizer.

* * * * *